US012624882B2

(12) United States Patent
Schroeder et al.

(10) Patent No.: US 12,624,882 B2
(45) Date of Patent: May 12, 2026

(54) REFRIGERATOR APPLIANCE INCLUDING MULTIPLE IN-DOOR ICE MAKERS

(71) Applicant: Haier US Appliance Solutions, Inc., Wilmington, DE (US)

(72) Inventors: Michael Goodman Schroeder, Crestwood, KY (US); Choonjae Ryu, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 46 days.

(21) Appl. No.: 18/790,632

(22) Filed: Jul. 31, 2024

(65) Prior Publication Data

US 2026/0036356 A1 Feb. 5, 2026

(51) Int. Cl.
*F25C 5/04* (2006.01)

(52) U.S. Cl.
CPC ..... *F25C 5/04* (2013.01); *F25C 2400/10* (2013.01); *F25C 2400/14* (2013.01); *F25C 2700/04* (2013.01)

(58) Field of Classification Search
CPC .... F25C 2400/10; F25C 5/22; F25C 2400/14; F25C 1/24; F25C 5/04; F25C 2700/04
See application file for complete search history.

(56) References Cited

U.S. PATENT DOCUMENTS

| | | | | |
|---|---|---|---|---|
| 2,024,612 | A | 12/1935 | Sulzberger | |
| 4,923,494 | A | 5/1990 | Karlovits | |
| 5,177,980 | A | 1/1993 | Kawamoto et al. | |
| 6,442,954 | B1 | 9/2002 | Shapiro et al. | |
| 7,386,993 | B2 | 6/2008 | Castrellón et al. | |
| 7,475,562 | B2 | 1/2009 | Jackovin | |
| 8,516,845 | B2 | 8/2013 | Wuesthoff et al. | |
| 9,448,003 | B2 | 9/2016 | Jin | |
| 9,689,600 | B2 | 6/2017 | Jin | |
| 9,759,471 | B2 | 9/2017 | Leclear et al. | |
| 10,670,317 | B2 | 6/2020 | Wu | |
| 11,073,320 | B2 | 7/2021 | Alshourbagy et al. | |
| 11,131,493 | B2 | 9/2021 | Boarman et al. | |
| 11,654,383 | B2 | 5/2023 | Mitchell et al. | |
| 2010/0050681 | A1* | 3/2010 | Ryu | F25D 11/022 62/344 |

(Continued)

FOREIGN PATENT DOCUMENTS

| | | | |
|---|---|---|---|
| CN | 102297556 | B | 8/2015 |
| CN | 219199375 | U | 6/2023 |

(Continued)

*Primary Examiner* — Nelson J Nieves
(74) *Attorney, Agent, or Firm* — Dority & Manning, P.A.

(57) ABSTRACT

A refrigerator appliance includes a cabinet forming a fresh food compartment and a freezer compartment, the cabinet including a water inlet; a first ice maker configured to produce a first style of ice; a second ice maker configured to produce a second style of ice different from the first style of ice; and a water tank in fluid communication with each of the first ice maker and the second ice maker, the water tank being configured to store a quantity of water, wherein the first ice maker is upstream from the water tank and the water tank is upstream from the second ice maker, and wherein water from the first ice maker is selectively supplied to the water tank after a harvesting operation is performed within the first ice maker.

20 Claims, 8 Drawing Sheets

(56) References Cited

U.S. PATENT DOCUMENTS

| | | | | |
|---|---|---|---|---|
| 2010/0147001 | A1 | 6/2010 | Kim et al. | |
| 2010/0251747 | A1 | 10/2010 | Lee | |
| 2011/0146325 | A1 | 6/2011 | Lee | |
| 2011/0162406 | A1 | 7/2011 | Shin et al. | |
| 2012/0111048 | A1* | 5/2012 | Kim | F25C 1/10 62/340 |
| 2012/0272670 | A1 | 11/2012 | Choi et al. | |
| 2022/0057128 | A1* | 2/2022 | Kim | F25C 5/04 |
| 2022/0107127 | A1 | 4/2022 | Mitchell et al. | |
| 2022/0235991 | A1 | 7/2022 | Shi et al. | |
| 2022/0275988 | A1* | 9/2022 | Park | F25D 11/02 |
| 2022/0282898 | A1* | 9/2022 | Pagnozzi | F25D 23/126 |
| 2022/0381507 | A1* | 12/2022 | Tae | F25D 23/028 |
| 2023/0003431 | A1 | 1/2023 | Junge et al. | |
| 2023/0138774 | A1 | 5/2023 | Junge et al. | |
| 2023/0243565 | A1* | 8/2023 | Kim | F25C 1/04 62/139 |
| 2023/0251009 | A1* | 8/2023 | Jeong | F25D 25/025 62/344 |
| 2023/0375247 | A1* | 11/2023 | Dos Santos, Jr. | F25D 23/028 |
| 2025/0172334 | A1* | 5/2025 | Mitchell | F25C 1/25 |
| 2025/0283649 | A1* | 9/2025 | Ryu | F25C 5/22 |
| 2025/0297794 | A1* | 9/2025 | Ye | F25C 1/25 |
| 2025/0354741 | A1* | 11/2025 | Vijayan | F25C 1/25 |

FOREIGN PATENT DOCUMENTS

| | | | |
|---|---|---|---|
| EP | 4235067 | A1 | 8/2023 |
| JP | 2003083661 | A | 3/2003 |
| JP | 2007057198 | A | 3/2007 |
| JP | 2010071565 | A | 4/2010 |
| KR | 200283929 | Y1 | 1/2003 |
| KR | 100559703 | B1 | 3/2006 |
| KR | 2006060449 | A | 6/2006 |
| KR | 101581198 | B1 | 1/2016 |
| KR | 2018117790 | A | 10/2018 |
| KR | 102049659 | B1 | 11/2019 |
| KR | 20210031250 | A | 3/2021 |
| KR | 20220045406 | A | 4/2022 |
| KR | 102422062 | B1 | 12/2022 |
| KR | 20230132174 | A | 9/2023 |
| WO | WO2008061179 | A2 | 5/2008 |
| WO | WO2023088217 | A1 | 5/2023 |

* cited by examiner

REFRIGERATOR APPLIANCE INCLUDING MULTIPLE IN-DOOR ICE MAKERS

FIELD OF THE INVENTION

The present subject matter relates generally to refrigerator appliances, and more particularly to refrigerator appliances including multiple ice makers using recycled water.

BACKGROUND OF THE INVENTION

Refrigerator appliances generally include a cabinet that defines chilled chambers for receipt of food items for storage. One or more insulated, sealing doors are provided for selectively enclosing the chilled food storage chambers. Recently, refrigerator appliances increasingly include built-in ice makers and dispensers for dispensing the formed ice and chilled water.

In certain refrigerator appliances, commonly referred to as side-by-side style refrigerator appliance, the fresh food chamber is positioned next to the freezer chamber within the cabinet. Such a configuration can permit easy access to food items stored on doors of the refrigerator appliances. In such implementations, ice makers may be provided within the freezer chamber or freezing compartment. A supply channel or duct may allow the formed ice to be dispensed through an in-door dispenser upon request. Further, multiple ice makers may be included in the appliance to provide additional ice, different ice styles, different ice sizes, or the like. However, certain drawbacks are prevalent in existing appliances. For instance, extra plumbing can be required to drain certain ice makers that do not fully utilize all supplied water.

Accordingly, a refrigerator appliance which obviates one or more of the above-mentioned drawbacks would be beneficial. In particular, a refrigerator appliance including multiple ice makers including improved water feed and recycling features would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet forming a fresh food compartment and a freezer compartment, the cabinet including a water inlet; a first ice maker provided within the freezer compartment, the first ice maker configured to produce a first style of ice; a second ice maker provided within the freezer compartment adjacent to the first ice maker, the second ice maker configured to produce a second style of ice different from the first style of ice; and a water tank in fluid communication with each of the first ice maker and the second ice maker, the water tank being configured to store a quantity of water, wherein the first ice maker is upstream from the water tank and the water tank is upstream from the second ice maker, and wherein water from the first ice maker is selectively supplied to the water tank after a harvesting operation is performed within the first ice maker.

In another exemplary aspect of the present disclosure, a refrigerator appliance is provided. The refrigerator appliance may include a cabinet forming a fresh food compartment and a freezer compartment, the cabinet including a water inlet; a first ice maker provided within the freezer compartment, the first ice maker configured to produce a first style of ice; a second ice maker provided within the freezer compartment adjacent to the first ice maker, the second ice maker configured to produce a second style of ice different from the first style of ice; a water tank in fluid communication with each of the first ice maker and the second ice maker, the water tank being configured to store a quantity of water, wherein the first ice maker is upstream from the water tank and the water tank is upstream from the second ice maker; a first water level sensor configured to detect a minimum water level within the water tank; a second water level sensor configured to detect a maximum water level within the water tank; and a controller operably coupled with each of the first ice maker, the second ice maker, and the water tank, the controller configured to perform an operation. The operation may include performing a harvesting operation at the first ice maker; determining, via the second water lever sensor, that the quantity of water within the water tank is below the maximum water level; supplying leftover water from the first ice maker to the water tank after performing the harvesting operation and determining that the quantity of water within the water tank is below the maximum water level; receiving an input request from the second ice maker; and supplying a predetermined amount of water from the water tank to the second ice maker in response to receiving the input request from the second ice maker.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
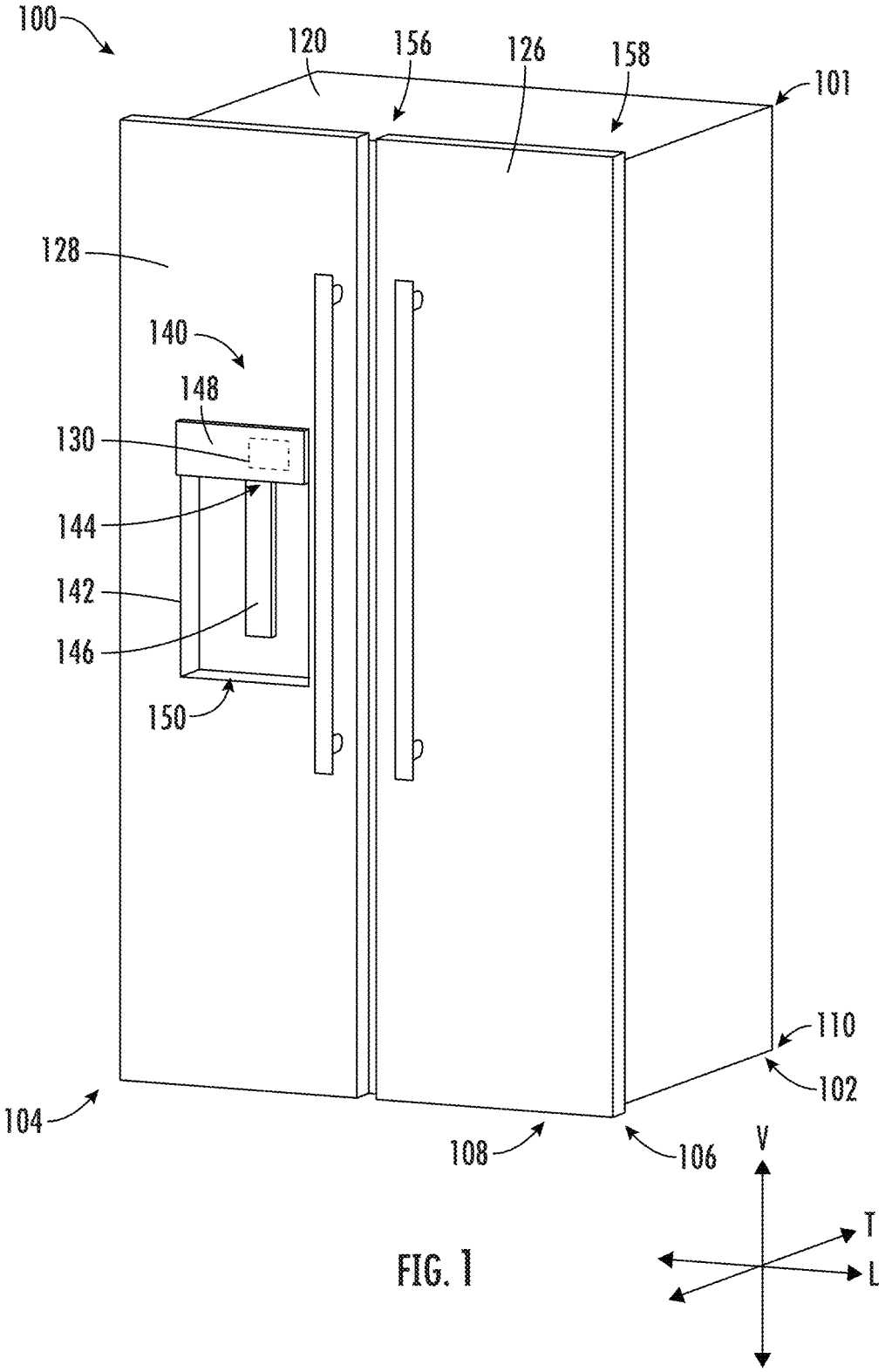
FIG. 1 provides a front view of an exemplary refrigerator appliance according to one or more embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
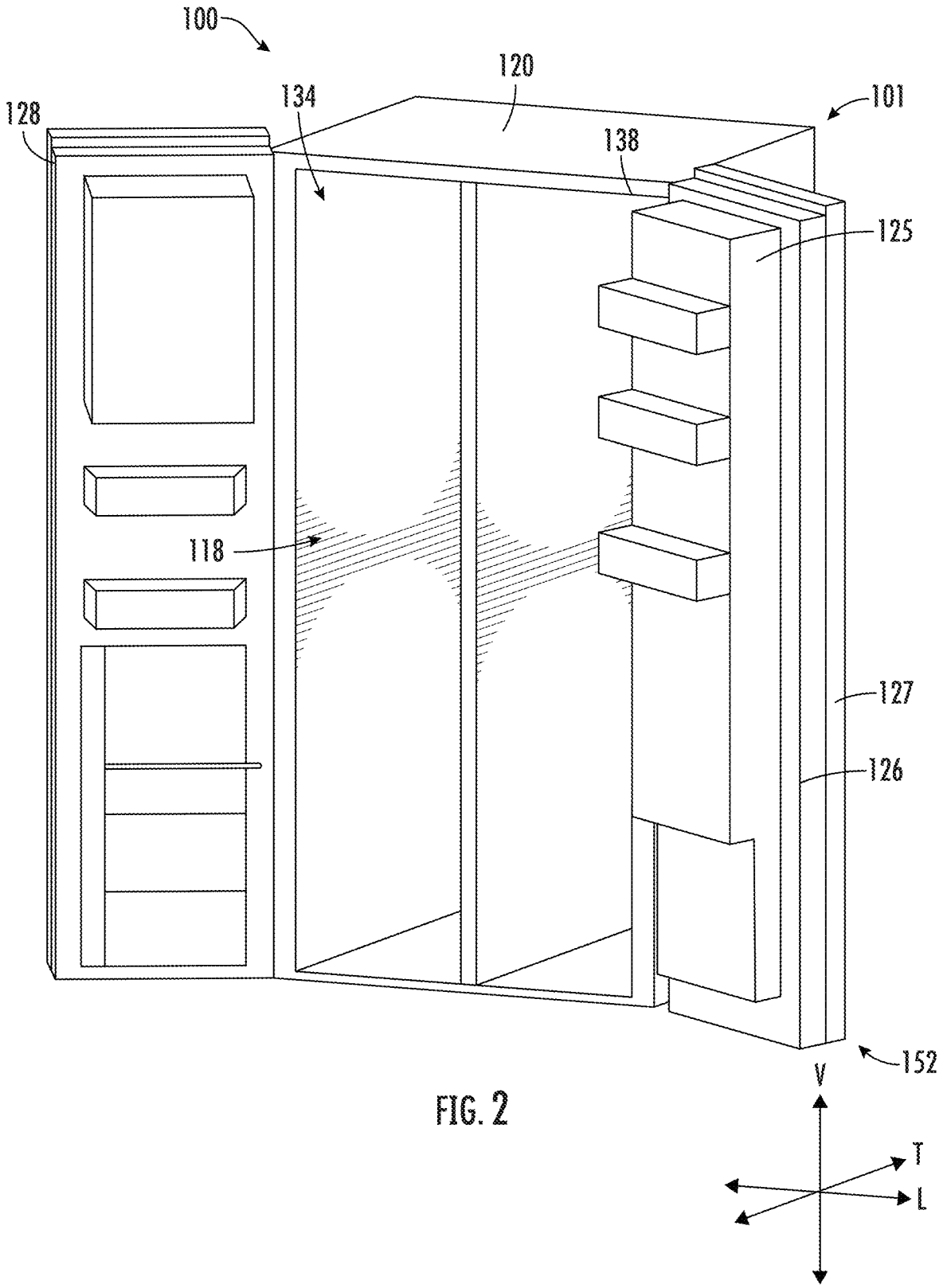
FIG. 2 provides a front view of the refrigerator appliance of FIG. 1 with appliance doors in an open position.

FIGS. 1 and 2 provide a perspective views of an exemplary refrigerator appliance 100 according to one or more embodiments of the present subject matter with doors 126, 128 (described in more detail below) closed in FIG. 1 and open in FIG. 2. Refrigerator appliance 100 defines a vertical direction V, a lateral direction L, and a transverse direction T, each mutually perpendicular to one another. As may be seen in FIGS. 1 and 2, refrigerator appliance 100 includes a cabinet or housing 120 that extends between a top 101 and a bottom 102 along a vertical direction V, between a left side 104 and a right side 106 along the lateral direction L, and between a front 108 and a rear 110 along the transverse direction T. Housing 120 defines a chilled chamber 118 for receipt of food items for storage. As used herein, the chamber may be "chilled" in that the chamber is operable at temperatures below room temperature, e.g., less than about seventy-five degrees Fahrenheit (75° F.). In particular, chilled chamber 118 may include a fresh food portion 122 and a freezer portion 124. For example, fresh food portion 122 may be operable within a temperature range above the freezing point of water and below room temperature, such as between approximately thirty-three degrees Fahrenheit (33° F.) and approximately sixty degrees Fahrenheit (60° F.). Also by way of example, freezer portion 124 may be operable within a temperature range including temperatures less than thirty-two degrees Fahrenheit (32° F.), such as between approximately thirty degrees Fahrenheit (30° F.) and approximately zero degrees Fahrenheit (0° F.). For example, a temperature of fresh food portion 122 may be about forty degrees Fahrenheit (40° F.) or about forty-five degrees Fahrenheit (45° F.) and a temperature of freezer portion 124 may be about fifteen degrees Fahrenheit (15° F.) or about twenty-five degrees Fahrenheit (25° F.). Freezer portion 124 and fresh food portion 122 may be separated by a thermally insulated partition 200. Partition 200 may be a vertical partition, e.g., the partition may extend along the vertical direction V. The thermally insulated partition 200 may permit or enhance operation of fresh food portion 122 and freezer portion 124 at distinct temperatures. One of ordinary skill in the art will recognize that chilled chamber 118 and the various portions thereof may be chilled by a sealed refrigeration system, such that chilled chamber 118, fresh food portion 122, and/or freezer portion 124 may be operable at or about the temperatures described above by providing chilled air from the sealed system. The structure and function of such sealed systems are understood by those of ordinary skill in the art and are not described in further detail herein for the sake of brevity and clarity.

Each of fresh food portion 122 and freezer portion 124 of chilled chamber 118 may extend along the vertical direction V between the top 101 and the bottom 102 of cabinet 120. A front portion of chilled chamber 118 may define an opening 138 for receipt of food items. Freezer portion 124 may be positioned adjacent to fresh food portion 122 (e.g., along the lateral direction L). For example, each of fresh food portion 122 and freezer portion 124 may extend from a bottom of chilled chamber 118 to a top of chilled chamber 118.

The refrigerator doors may include a fresh food door 126 and a freezer door 128 may be rotatably mounted, e.g., hinged, to an edge of housing 120 for selectively accessing fresh food portion 122 and freezer portion 124, respectively, of chilled chamber 118 within housing 120. Refrigerator doors 126 and 128 may be mounted to housing 120 at or near front portion 134 of chilled chamber 118 such that fresh food door 126 and freezer door 128 rotate between a closed position (FIG. 1) and an open position (FIG. 2). In the closed position of FIG. 1, doors 126 and 128 cooperatively sealingly enclose chilled chamber 118. Additionally, one or more gaskets and other sealing devices, which are not shown but will be understood by one of ordinary skill in the art, may be provided to promote sealing between doors 126 and 128 and cabinet 120. In the open position of FIG. 2, doors 126 and 128 permit access to each of fresh food portion 122 and freezer portion 124. Fresh food door 126 and freezer door 128 may be generally mirrored, e.g., the overall shape and size of each door 126 or 128 may be the same as the other door 126 or 128, with possible internal variations such as a dispenser recess 150. Moreover, although not specifically shown, doors 126 and 128 may be independently rotatable such that, e.g. fresh food door 126 may be in the open position while freezer door 128 is in the closed position, or vice versa.

Various storage components may be mounted within fresh food portion 122 and freezer portion 124 to facilitate storage of food items therein as will be understood by those skilled in the art. In particular, the storage components may include various combinations of bins, drawers, and shelves mounted within fresh food portion 122 and freezer portion 124. The bins, drawers, and shelves may be configured for receipt of food items (e.g., beverages and/or solid food items) and may assist with organizing such food items.

As may be seen in FIG. 1, refrigerator appliance 100 may include a dispensing assembly 140 for dispensing liquid water and/or ice. Dispensing assembly 140 may include a water dispenser 142 positioned on or mounted to an exterior portion of refrigerator appliance 100 (e.g., on one of doors 126 and 128, such as freezer door 128). Dispenser 142 may include a discharging outlet 144 for accessing ice and liquid water. An actuating mechanism 146, shown as a paddle, may be mounted below discharging outlet 144 for operating dispenser 142. In alternative exemplary embodiments, any suitable actuating mechanism may be used to operate dispenser 142. For example, dispenser 142 may include a sensor (such as an ultrasonic sensor) or a button rather than the paddle. A user interface panel 148 may be provided for controlling the mode of operation. For example, user interface panel 148 may include a plurality of user inputs (not labeled), such as a water dispensing button and an ice-dispensing button, for selecting a desired mode of operation such as crushed or non-crushed ice.

Discharging outlet 144 and actuating mechanism 146 may be formed as an external part of dispenser 142 and may thus be mounted in dispenser recess 150. Dispenser recess 150 may be positioned on an exterior side or face of one of the refrigerator doors 126 and 128 (e.g., freezer door 128), at a predetermined elevation convenient for a user to access ice or water and enabling the user to access ice without the need to bend-over and without the need to open doors 126 and 128. In the exemplary embodiment, dispenser recess 150 is positioned at a level that approximates the chest level of a user.

Appliance 100 may further include or be in operative communication with a processing device or a controller 130 that may be generally configured to facilitate appliance operation. In this regard, user interface panel 148, certain user input devices, a display, and the like may be in communication with controller 130 such that controller 130 may receive control inputs from user interface panel 148, may display information using the display, and may otherwise regulate operation of appliance 100. For example, signals generated by controller 130 may operate appliance 100, including any or all system components, subsystems, or interconnected devices, in response to the position of user interface panel 148 and other control commands. User interface panel 148 and other components of appliance 100 may be in communication with controller 130 via, for example, one or more signal lines or shared communication busses. In this manner, Input/Output ("I/O") signals may be routed between controller 130 and various operational components of appliance 100.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 130 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 130 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 130 may be operable to execute programming instructions or micro-control code associated with an operating cycle of appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 130 as disclosed herein is capable of and may be operable to perform any methods, method steps, or portions of methods as disclosed herein. For example, in some embodiments, methods disclosed herein may be embodied in programming instructions stored in the memory and executed by controller 130.

The memory devices may also store data that can be retrieved, manipulated, created, or stored by the one or more processors or portions of controller 130. The data can include, for instance, data to facilitate performance of one or more methods. The data can be stored locally (e.g., on controller 130) in one or more databases and/or may be split up so that the data is stored in multiple locations. In addition, or alternatively, the one or more database(s) can be connected to controller 130 through any suitable network(s), such as through a high bandwidth local area network (LAN) or wide area network (WAN). In this regard, for example, controller 130 may further include a communication module or interface that may be used to communicate with one or more other component(s) of appliance 100, controller 130, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Figure 3:
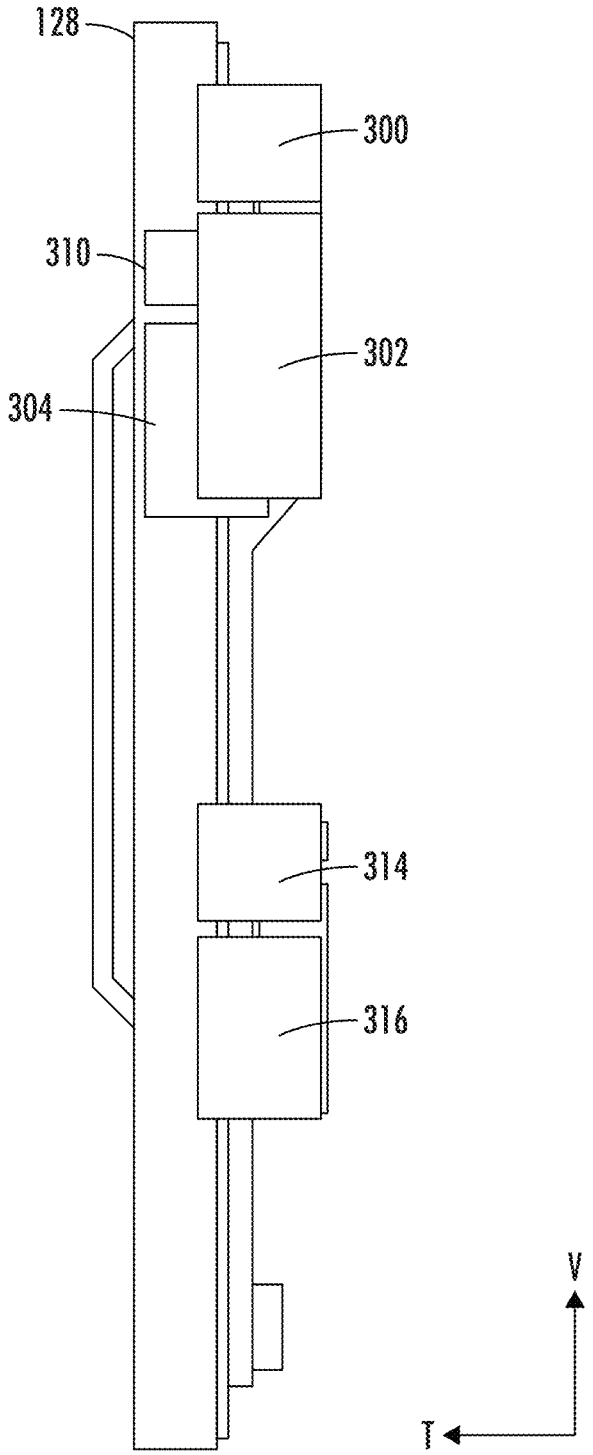
FIG. 3 provides a side view of a refrigerator appliance door including multiple ice makers according to exemplary embodiments of the present disclosure.
Figure 4:
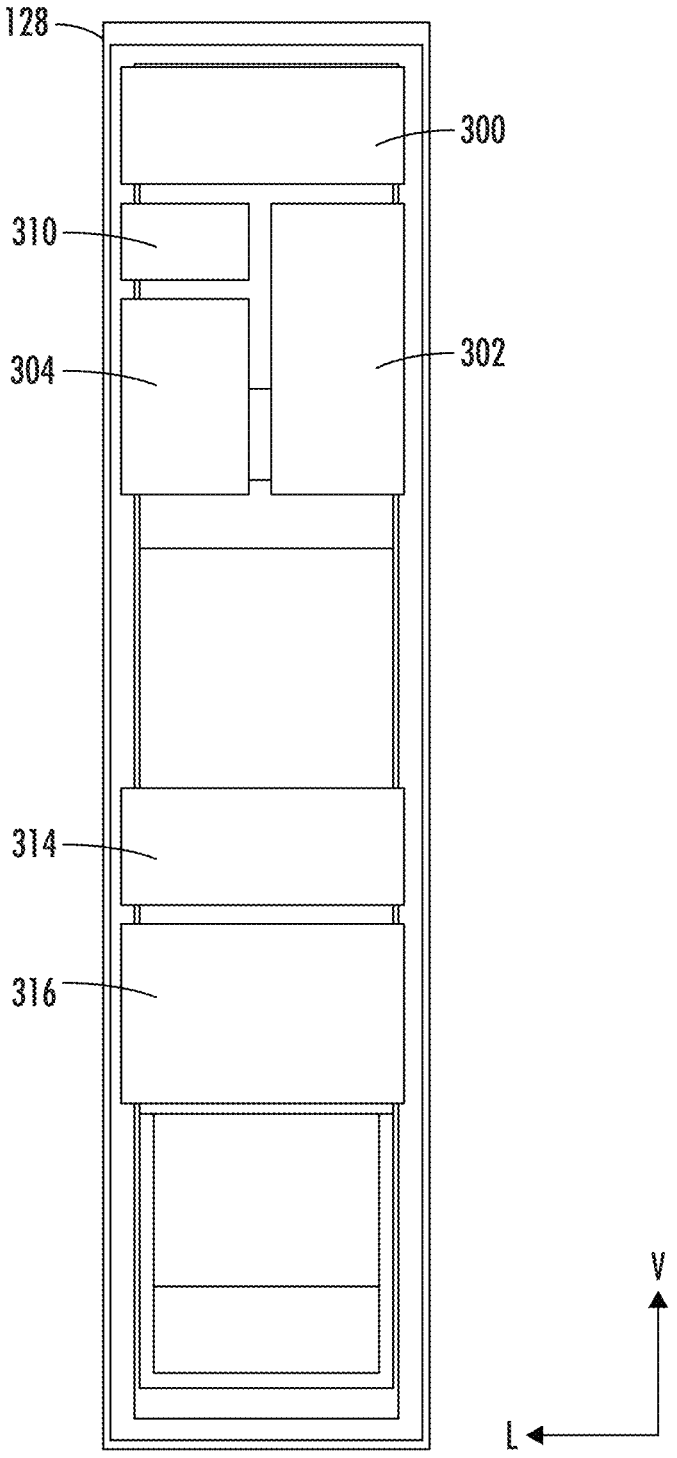
FIG. 4 provides a rear view of the exemplary refrigerator appliance door of FIG. 3.
Figure 5:
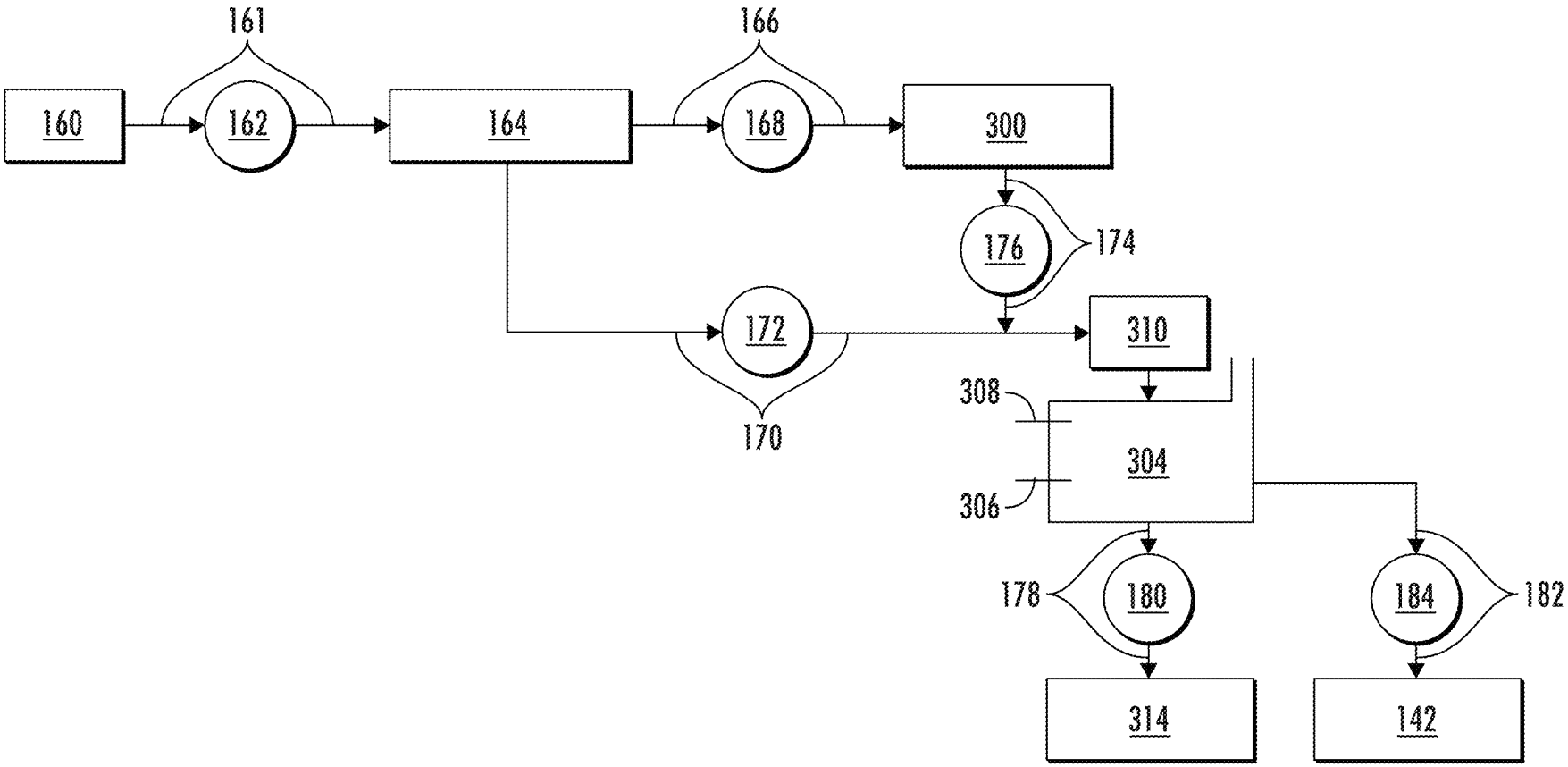
FIG. 5 provides a schematic view of a first ice maker, a second ice maker, a water tank, and associated water lines of the exemplary refrigerator appliance door of FIG. 3.

Referring now to FIGS. 3 through 5, an embodiment of a freezer door or freezer chamber door 128 will be described in detail. For instance, refrigerator appliance 100 may include a plurality of ice makers installed or positioned within freezer chamber 124. According to some embodiments, each of the ice makers may be installed on an internal or interior surface of freezer door 128. The plurality of ice makers may include a first ice maker 300. According to the exemplary embodiment, first ice maker 300 may be installed at or near a top of freezer door 128 (e.g., along the vertical direction V). First ice maker 300 may be configured to create, form, freeze, or otherwise produce a unique style of ice, or a first style of ice. For instance, first ice maker 300 may produce a clear ice. Hereinafter, clear ice may include ice shapes or forms with limited deformities in the form of cloudiness, total dissolved solids (TDS), or other impurities. It is noted that the structure and function of clear ice makers are understood by those of ordinary skill in the art and are not described in further detail for the sake of brevity and clarity.

Referring briefly to FIG. 5, first ice maker 300 may be operably connected with a water inlet 160. Water inlet 160 may be positioned within cabinet 120. A water source (e.g., municipal water, tap water, etc.) may enter appliance 100 via water inlet 160. Water inlet 160 may include one or more lines (e.g., tubes, pipes, conduits, etc.) through which water is subsequently supplied through appliance 100. For instance, an inlet line 161 may extend from water inlet 160 through cabinet 120. An inlet valve 162 may be positioned along inlet line 161. Inlet valve 162 may selectively open and close to permit or restrict a flow of water through inlet line 161. Inlet valve 162 may be any suitable valve, such as a check valve, a solenoid valve, a gate valve, or the like.

Appliance 100 may include a main filter 164. Main filter 164 may be positioned along inlet line 161. For instance, main filter 164 may be positioned downstream from inlet valve 162. Additionally or alternatively, main filter 164 may be positioned within cabinet 120 of appliance 100. Main filter 164 may provide a filtration of the water supplied to appliance 100 via water inlet 160. For instance, main filter 164 may include a carbon block filter material. However, it should be understood that any suitable filter or filter material may be utilized within main filter 164.

Appliance 100 may include a first water supply line 166. First water supply line 166 may fluidly connect first ice maker 300 with main filter 164. For instance, first water supply line 166 may include one or more tubes, pipes, conduits, or the like extending from main filter 164 to first ice maker 300. A first supply valve 168 may be positioned along first water supply line 166. First supply valve 168 may be any suitable valve, such as a check valve, a solenoid valve, a gate valve, or the like. Additionally or alternatively, first water supply line 166 may branch from a three-way valve positioned within cabinet 120, according to some embodiments.

Appliance may include a first ice bucket 302. For instance, first ice bucket 302 may be configured to store ice formed within first ice maker 300. First ice bucket 302 may thus define a compartment in which the formed ice shapes may be deposited. According to some embodiments, first ice bucket 302 is operably connected with dispensing assembly 140. Accordingly, ice stored within first ice bucket 302 may be selectively released via dispensing assembly 140 (e.g., according to an input from a user). First ice bucket 302 may be positioned beneath first ice maker 300 along the vertical direction V. However, it should be understood that a specific position of first ice bucket 302 is not limited to the examples provided herein.

Appliance 100 may include a water tank 304. Water tank 304 may be positioned on the interior surface of freezer door 128. Water tank 304 may be configured to store a quantity of water. For instance, water tank 304 may be fluidly connected with water inlet 160. Water from water inlet 160 may thus be selectively supplied to water tank 304 (e.g., according to requests, inputs, schedules, or the like). Water tank 304 may be positioned below first ice maker 300 along the vertical direction V. Additionally or alternatively, water tank 304 may include an air vent 312. For instance, water tank 304 may include one or more openings through which air may enter or exit the receiving chamber thereof such that a pressure within water tank 304 is maintained at a stable, predetermined pressure commensurate with an ambient pressure. Further still, water tank 304 may be in fluid communication with dispensing assembly 140. Thus, water within water tank 304 may be selectively delivered or flowed to dispenser 142, e.g., according to a user demand.

Appliance 100 may include a second water supply line 170. Second water supply line 170 may fluidly connect water tank 304 with main filter 164. For instance, second water supply line 170 may include one or more tubes, pipes, conduits, or the like extending from main filter 164 to water tank 304. A second supply valve 172 may be positioned along second water supply line 170. Second supply valve 172 may be any suitable valve, such as a check valve, a solenoid valve, a gate valve, or the like. Additionally or alternatively, second water supply line 170 may branch from a three-way valve positioned within cabinet 120, according to some embodiments. For instance, each of first water supply line 166 and second water supply line 170 may branch from a single three-way valve positioned within cabinet such that water from main filter 164 may be directed to either first supply line 166 or second supply line 170. Thus, first supply line 166 and second supply line 170 may be in fluid parallel with each other.

Water tank 304 may include a plurality of water level sensors. In detail, water tank 304 may include a first water level sensor 306 and a second water level sensor 308. First water level sensor 306 may be configured to detect a minimum water level within water tank 304. For instance, first water level sensor 306 may be positioned at a first predetermined height along the vertical direction V within water tank 304 (e.g., near a bottom of water tank 304). First water level sensor 306 may be configured to detect or trigger when the water within water tank 304 is depleted to the minimum water level.

Similarly, second water level sensor 308 may be configured to detect a maximum water level within water tank 304. For instance, second water level sensor 308 may be positioned at a second predetermined height along the vertical direction V within water tank 304 (e.g., near a top of water tank 304). Accordingly, the second predetermined height may be higher than the first predetermined height. Second water level sensor 308 may be configured to detect or trigger when the water within water tank 304 is filled to the maximum water level.

Appliance 100 may include an impurity water line 174. Impurity water line 174 may fluidly connect first ice maker 300 with water tank 304. For instance, impurity water line 174 may include one or more tubes, pipes, conduits, or the like extending from a bottom or outlet of first ice maker 300 to water tank 304. According to some embodiments, a distal end of impurity water line is connected with second water supply line 170 downstream from second supply valve 172. As mentioned above, first ice maker 300 may be configured to form, create, or otherwise produce a clear ice. The formation of clear ice may result in excess leftover water containing higher concentrations of impurities (such as TDS, gasses, etc.). Thus, the excess impure water may be selectively flowed from first ice maker 300 to water tank 304 (e.g., according to a trigger, an input, or the like).

Impurity water line 174 may include a check valve 176. Check valve 176 may be positioned fluidly along impurity water line 174 between first ice maker 300 and water tank 304. Check valve 176 may be configured to selectively open and close the impurity water line 174. In some instances, the operation of check valve 176 is correlated with the measured volume or quantity of water within water tank 304 (e.g., via first water level sensor 306 or second water level sensor 308). For one example, check valve 176 moves to an open position to open impurity line 174 when the quantity or volume of water within water tank 304 is less than the maximum water level after a harvesting operation is performed within first ice maker 300. Thus, is the volume of water within water tank 304 is at or above the maximum water level, check valve 176 is maintained in the closed position. Check valve 176 may thus be operably connected with controller 130 to receive inputs or commands therefrom (e.g., based on other operational components within appliance 100.

Appliance 100 may include a secondary filter 310. Secondary filter 310 may be positioned along impurity water line 174. For instance, secondary filter 310 may be positioned downstream from check valve 176. In some instance, secondary filter 310 is positioned along second water supply line 170 downstream from a connection point between impurity water line 174 and second water supply line 170. Thus, secondary filter may be positioned at or near an inlet to water tank 304. As would be understood, water from first ice maker 300 being flowed to water tank 304 may be filtered by secondary filter 310. Secondary filter 310 may include any suitable type or style filter, such as a gravity filter, a carbon filter, a particulate filter, or the like. However, the disclosure is not limited to the examples provided herein and secondary filter may include additional or alternative filtering means.

Appliance 100 may include a second ice maker 314. Second ice maker 314 may be attached to or positioned along the internal or interior surface of freezer door 128. For instance, second ice maker 314 may be positioned adjacent to water tank 304. According to the embodiment described in FIGS. 3 through 5, first ice maker 300 is positioned above water tank 304 along the vertical direction V, and water tank 304 is positioned above second ice maker 314 along the vertical direction V. However, the placement of second ice maker 314 with respect to each of water tank 304 and first ice maker 300 may vary according to specific embodiments. For instance, second ice maker 314 may be positioned adjacent to first ice maker 300.

Second ice maker 314 may be configured to create, form, freeze, or otherwise produce a unique style of ice, or a second style of ice. The second style of ice may be different from the first style of ice formed by first ice maker 300. For instance, second ice maker 314 may produce a traditional ice (e.g., a cloudy ice). Hereinafter, traditional ice may include ice shapes or forms with higher deformities or other impurities in the form of cloudiness, total dissolved solids (TDS), and the like. It is noted that the structure and function of standard ice makers are understood by those of ordinary skill in the art and are not described in further detail for the sake of brevity and clarity.

Second ice maker 314 may be fluidly connected with water tank 304. For instance, second ice maker 314 may be downstream from water tank 304. Accordingly, second ice maker 314 may selectively receive a water supply from water tank 304 (e.g., according to demands, inputs, signals, etc.). Thus, according to some embodiments, second ice maker 314 is not directly in fluid communication with water inlet 160. For instance, water from second water supply line 170 may be supplied to water tank 304 together with the waste water from first ice maker 300. The mixed water may then be selectively supplied to second ice maker 314. Accordingly, as mentioned above, water within water tank 304 may be selectively supplied to each of second ice maker 314 and dispenser 142.

Appliance 100 may include a second ice bucket 316. Second ice bucket 316 may be configured to store ice formed within second ice maker 300. Second ice bucket 316 may thus define a compartment in which the formed ice shapes may be deposited. According to some embodiments, second ice bucket 316 is operably connected with dispensing assembly 140. Accordingly, ice stored within second ice bucket 316 may be selectively released via dispensing assembly 140 (e.g., according to an input from a user). Second ice bucket 316 may be positioned beneath second ice maker 314 along the vertical direction V. However, it should be understood that a specific position of second ice bucket 316 is not limited to the examples provided herein.

Appliance 100 may include a third water supply line 178. Third water supply line 178 may fluidly connect water tank 304 with second ice maker 314. For instance, third water supply line 178 may include one or more tubes, pipes, conduits, or the like extending from an outlet of water tank 304 to an inlet of second ice maker 314. A third supply valve 180 may be positioned along third water supply line 178. Third supply valve 180 may be any suitable valve, such as a check valve, a solenoid valve, a gate valve, or the like.

Appliance 100 may include a dispenser supply line 182. Dispenser supply line 182 may fluidly connect water tank 304 with dispenser 142. For instance, dispenser supply line 182 may include one or more tubes, pipes, conduits, or the like extending from water tank 304 to dispensing assembly 140. A dispense valve 184 may be positioned along dispenser supply line 182. Dispense valve 184 may be any suitable valve, such as a check valve, a solenoid valve, a gate valve, or the like. In some instances, dispense valve 184 is positioned at or near discharging outlet 144 of dispenser 142.

Figure 6:
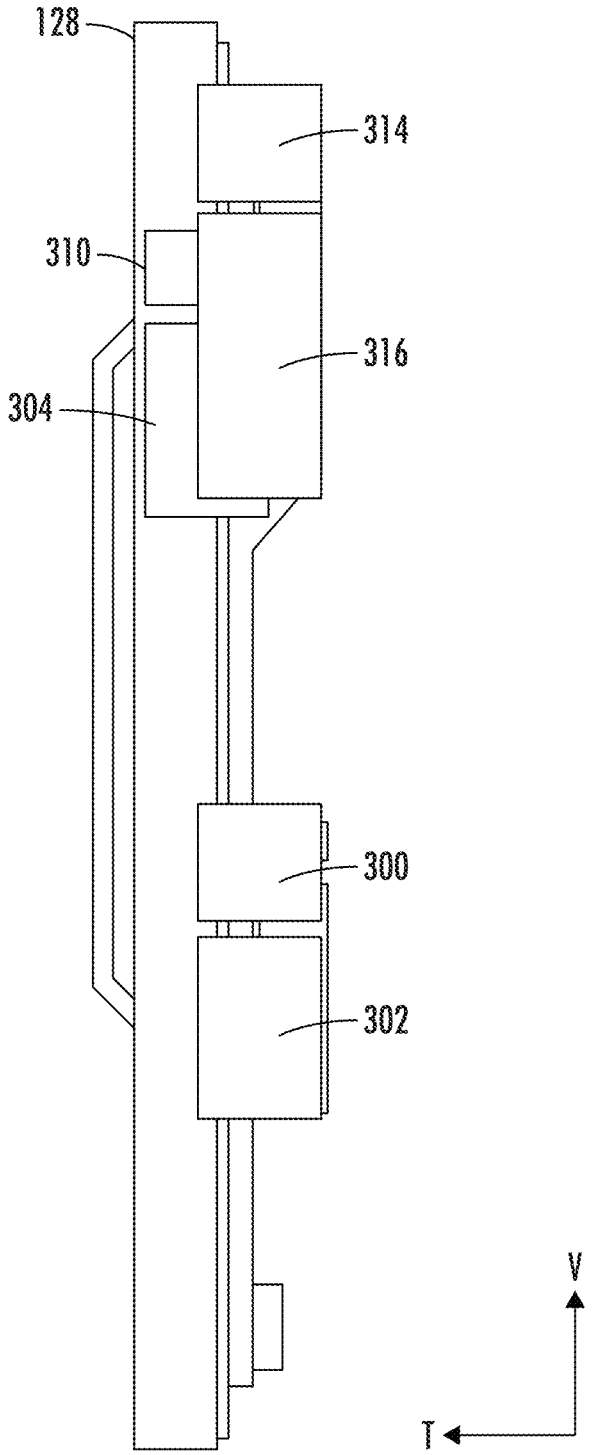
FIG. 6 provides a side view of a refrigerator appliance door including multiple ice makers according to exemplary embodiments of the present disclosure.
Figure 7:
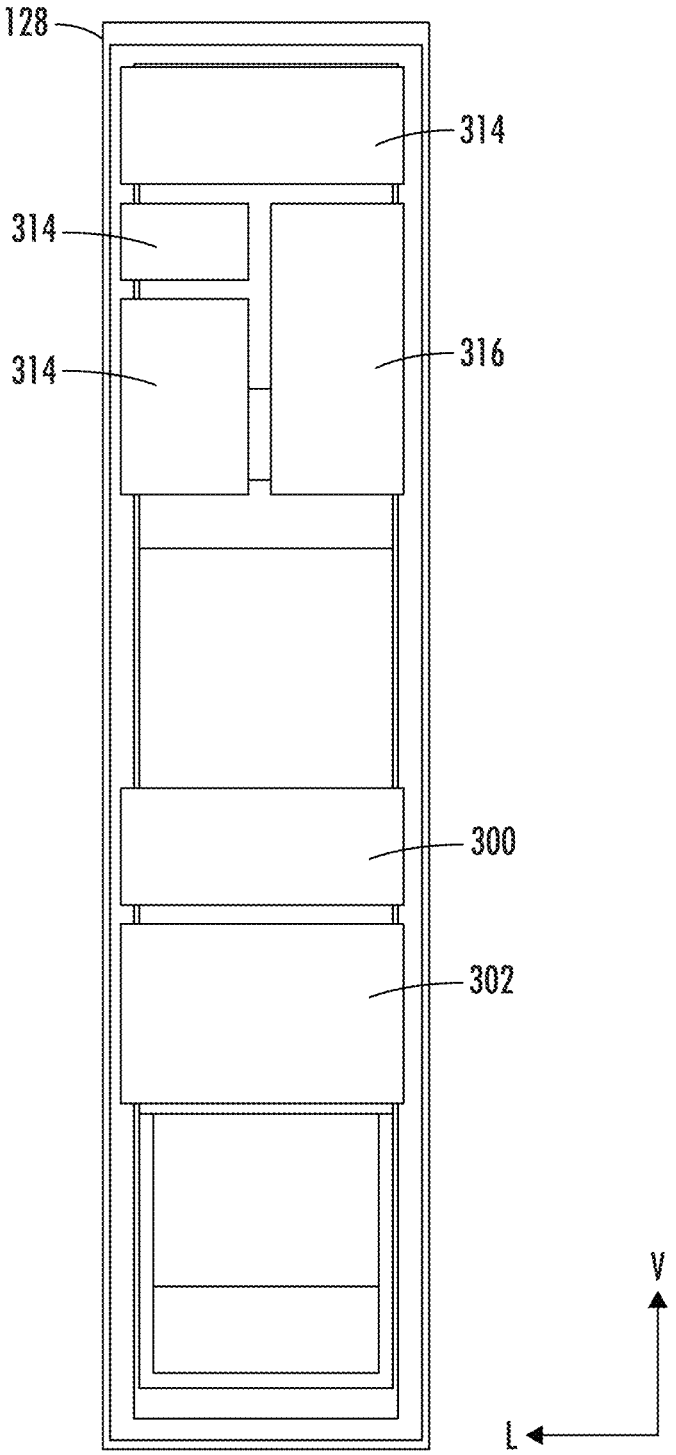
FIG. 7 provides a rear view of the exemplary refrigerator appliance door of FIG. 3.
Figure 8:
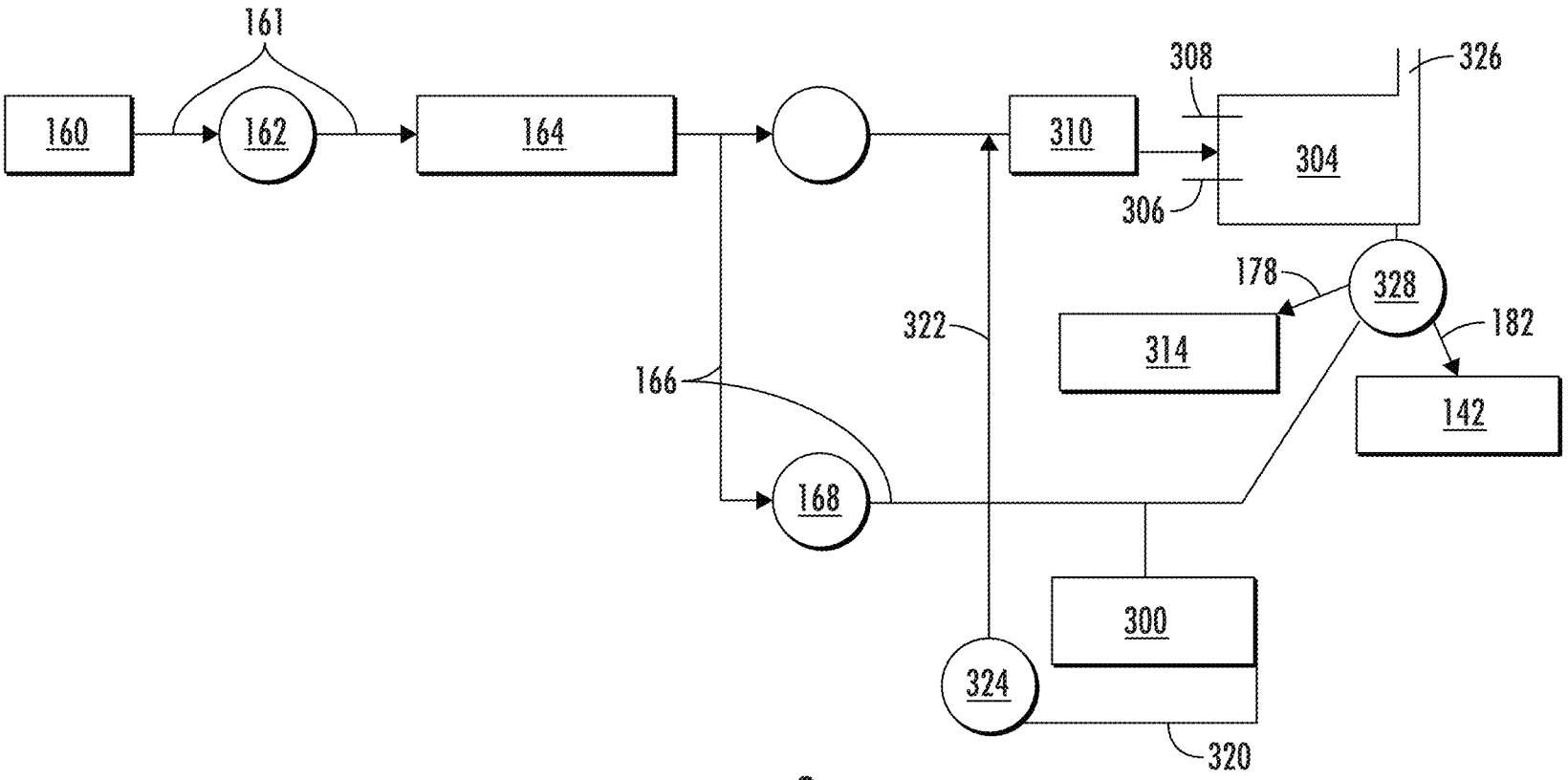
FIG. 8 provides a schematic view of a first ice maker, a second ice maker, a water tank, and associated water lines of the exemplary refrigerator appliance door of FIG. 3.

Referring now to FIGS. 6 through 8, another embodiment of a freezer door or freezer chamber door 128 will be described in detail. Due to similarities between embodiments described herein, like reference numerals may be used to refer to the same or similar features described above with respect to FIGS. 3 through 5. Additionally, a repeat description of similar features will be omitted for the sake of brevity.

As shown in FIGS. 6 through 8, according to this embodiment, second ice maker 314 is positioned above water tank 304 along the vertical direction V, and water tank 304 is positioned above first ice maker 300 along the vertical direction V. According to this embodiment, first ice maker 300 may still produce the first style of ice (e.g., clear ice)

while second ice maker 314 produces the second style of ice (e.g., traditional or normal ice). According to this embodiment, appliance 100 may include a sump 320. Sump 320 may be positioned at first ice maker 300. Sump 320 may be configured to collect waste water from first ice maker 300 during a harvesting operation of first ice maker 300. For instance, as described above, first ice maker 300 may form clear ice cubes. The formation of clear ice cubes may result in waste water including higher contents of impurities, such as TDS, which is then collected in sump 320.

Appliance 100 may include a waste line 322. Waste line 322 may fluidly connect sump 320 with water tank 304. Waste line 322 may include one or more tubes, pipes, or conduits extending from sump 320 toward water tank 304. For instance, water from sump 320 may flow toward water tank 304 via waste line 322 according to an input, a signal, a trigger, or the like. Secondary filter 310 may be provided along waste line 322 downstream from sump 320. The waste water flowed from sump 320 toward water tank 304 may thus be filtered by secondary filter 310 (e.g., as described above) before being supplied to water tank 304. According to some embodiments, waste line 322 flows into second water supply line 170 before entering water tank 304.

Appliance 100 may include a pump 324. Pump 324 may be positioned within sump 320, for instance. Pump 324 may be configured to pump the waste or impure water from sump 320 through waste line 322 to water tank 304. As mentioned above, water tank 304 may be positioned above first ice maker 300 along the vertical direction V. Thus, in order to overcome gravity, pump 324 may pump the waste water upward along the vertical direction V from sump 320 to water tank 304. Pump 324 may be any suitable pump configured to drive, urge, or otherwise circulate the water through waste line 322, such as a peristaltic pump, a centrifugal pump, or the like. Pump 324 may thus be operably connected with controller 130 to receive initiation signals therefrom.

Pump 324 may be activated upon receiving a signal (e.g., from controller 130). For instance, the water level within water tank 304 may be monitored by first water level sensor 306 and second water level sensor 308. According to some examples, pump 324 is activated when the quantity of water within water tank 304 is less than the maximum water level (e.g., as determined by second water level sensor 308). Advantageously, water tank 304 is prevented from overfilling and causing spillages within appliance 100.

According to some embodiments, water tank 304 may include a pressure relief valve 326. Pressure relief valve 326 may be provided in addition to or alternatively from air vent 312. For instance, water tank 304 may be maintained at a pressurized state. According to some instances, water tank 304 is maintained within a predetermined pressure range (e.g., via pressure relief valve 326). Pressure relief valve 326 may thus be configured to open upon detecting a pressure limit or threshold within water tank 304. Pressure relief valve 326 may thus be operably connected with controller 130 to receive signals therefrom.

Referring still to FIG. 8, according to some embodiments, water tank 304 may be fluidly connected with first ice maker 300 to both collect water therefrom and supply water thereto. In detail, appliance 100 may include a multi-way valve 328. Multi-way valve 328 may be positioned downstream from water tank 304. Multi-way valve 328 may be configured to receive water from water tank 304. Multi-way valve 328 may include a plurality of outlets, including a first outlet to water dispenser 142, a second outlet to second ice maker 314, and a third outlet to first ice maker 300. Accordingly, water stored within water tank 304 may be selectively supplied to each of water dispenser 142, first ice maker 300, and second ice maker 314. Multi-way valve 328 may be operably connected with controller 130. For instance, controller 130 may selectively open one or more of the first, second, and third outlets to supply water where requests are originated.

As mentioned above, controller 130 may be configured to perform one or more steps, commands, tasks, or the like. For one example, controller 130 may detect, via second water level sensor 308, that the quantity or volume of water within water tank 304 is at the maximum water level. Controller 130 may, for instance, receive one or more signals from second water level sensor 308 indicating the water level within water tank 304. In response to detecting the maximum water level, controller 130 may emit a notification. The notification may be emitted via user interface panel 148, e.g., as a graphic, text, picture, sound, or the like. Additionally or alternatively, the notification may be transmitted to a remote connected device (e.g., such as a mobile phone). The notification may include a request or instruction to manually empty water tank 304.

According to another embodiment, controller 130 may send an instruction to perform a harvesting operation at first ice maker 300. As mentioned, first ice maker 300 may be a clear ice maker resulting in excess waste water. Upon performing the harvesting operation at first ice maker 300, controller 130 may determine, via second water level sensor 308, that the quantity or volume of water within water tank 304 is below the maximum water level. The volume of water may be determined according to signals from either or both of first water level sensor 306 and second water level sensor 308. Controller 130 may thus determine that water tank has sufficient space to accommodate more water therein.

Controller 130 may then supply the leftover water from first ice maker 300 to water tank 304. For instance, with reference to FIGS. 3 through 5, controller 130 may open check valve 176 to allow water to flow from first ice maker 300 into water tank 304 (e.g., via secondary filter 310). For another example, with reference to FIGS. 6 through 8, controller 130 may initiate pump 324 to pump the excess water from sump 320 through waste line 322 up to water tank 304 (e.g., via secondary filter 310).

Controller 130 may receive a request (e.g., an input request) from second ice maker 314. The input request may be a request to form the second style of ice (e.g., normal ice, standard ice, etc.). The request may thus include a demand for water to supply second ice maker 314. For instance, second ice maker 314 may include a tray-style ice maker including one or more ice mold shapes in a tray. The request may require water to be supplied to the ice mold shapes.

Controller 130 may then supply a predetermined amount of water from water tank 304 to second ice maker 314. For instance, in respond to the request from second ice maker 314, controller 130 may initiate a supply of water from water tank 304. With reference again to FIGS. 3 through 5, controller 130 may open third supply valve 180 such that water is able to flow through third water supply line 178. Third supply valve 180 may be opened for a predetermined length of time such that a precise amount or volume of water is released to second ice maker 314. With reference to FIG. 8, controller 130 may direct multi-way valve 328 to open the second outlet such that water from water tank 304 is supplied to second ice maker 314.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the refrigerator appliance comprising:

a cabinet forming a fresh food compartment and a freezer compartment, the cabinet comprising a water inlet;

a first ice maker provided within the freezer compartment, the first ice maker configured to produce a first style of ice;

a second ice maker provided within the freezer compartment adjacent to the first ice maker, the second ice maker configured to produce a second style of ice different from the first style of ice; and a water tank in fluid communication with each of the first ice maker and the second ice maker, the water tank being configured to store a quantity of water, wherein the first ice maker is upstream from the water tank and the water tank is upstream from the second ice maker, and wherein water from the first ice maker is selectively supplied to the water tank after a harvesting operation is performed within the first ice maker.

2. The refrigerator appliance of claim 1, further comprising:

a water dispenser provided within a door of the refrigerator appliance, the water dispenser being in fluid communication with the water tank.

3. The refrigerator appliance of claim 1, wherein the quantity of water within the water tank is selectively supplied to the second ice maker and the dispenser.

4. The refrigerator appliance of claim 1, further comprising:

a main filter positioned at the water inlet within the cabinet to filter incoming water;

a first water supply line fluidly connecting the water inlet with the first ice maker via the main filter; and a second water supply line fluidly connecting the water inlet with the water tank via the main filter, wherein the first water supply line is in fluid parallel with the second water supply line.

5. The refrigerator appliance of claim 4, wherein the water tank comprises:

a first water level sensor configured to detect a minimum water level within the water tank; and a second water level sensor configured to detect a maximum water level within the water tank.

6. The refrigerator appliance of claim 5, wherein the first ice maker is positioned above the water tank along the vertical direction and the water tank is positioned above the second ice maker along the vertical direction.

7. The refrigerator appliance of claim 6, further comprising:

an impurity water line fluidly connecting the first ice maker with the water tank; and a check valve positioned along the impurity water line and configured to selectively open and close the impurity water line.

8. The refrigerator appliance of claim 7, wherein the check valve opens the impurity water line only when the quantity of water within the water tank is less than the maximum water level after performing the harvesting operation within the first ice maker.

9. The refrigerator appliance of claim 7 further comprising:

a secondary filter positioned along the impurity water line downstream from the check valve, wherein water from the first ice maker is filtered through the secondary filter before being supplied to the water tank.

10. The refrigerator appliance of claim 5, wherein the water tank comprises:

an air vent allowing air to selectively flow into and out of the water tank.

11. The refrigerator appliance of claim 5, wherein the second ice maker is positioned above the water tank along the vertical direction and the water tank is positioned above the first ice maker along the vertical direction.

12. The refrigerator appliance of claim 11, wherein the first ice maker comprises:

a sump configured to collect waste water from the first ice maker during a harvesting operation;

a waste line fluidly connecting the sump with the water tank; and a pump configured to selectively pump the collected waste water from the sump to the water tank along the waste line.

13. The refrigerator appliance of claim 12, wherein the pump is activated only when the quantity of water within the water tank is less than the maximum water level after performing the harvesting operation within the first ice maker.

14. The refrigerator appliance of claim 12, further comprising:

a secondary filter positioned along the waste line downstream from the check valve, wherein water from the sump is filtered through the secondary filter before being supplied to the water tank.

15. The refrigerator appliance of claim 11, wherein the water tank comprises:

a pressure relief valve configured to selectively release air pressure within the water tank, wherein the water tank is maintained within a predetermined pressure range.

16. The refrigerator appliance of claim 5, further comprising:

a controller operably coupled with each of the first ice maker, the second ice maker, and the water tank, the controller configured to perform an operation, the operation comprising:

detecting, via the second water level sensor, that the quantity of water within the water tank is at the maximum water level; and emitting a notification to empty the water tank.

17. A refrigerator appliance defining a vertical direction, a lateral direction, and a transverse direction, the refrigerator appliance comprising:

a cabinet forming a fresh food compartment and a freezer compartment, the cabinet comprising a water inlet;

a first ice maker provided within the freezer compartment, the first ice maker configured to produce a first style of ice;

a second ice maker provided within the freezer compartment adjacent to the first ice maker, the second ice maker configured to produce a second style of ice different from the first style of ice;

a water tank in fluid communication with each of the first ice maker and the second ice maker, the water tank being configured to store a quantity of water, wherein the first ice maker is upstream from the water tank and the water tank is upstream from the second ice maker;

a first water level sensor configured to detect a minimum water level within the water tank;

a second water level sensor configured to detect a maximum water level within the water tank; and a controller operably coupled with each of the first ice maker, the second ice maker, and the water tank, the controller configured to perform an operation, the operation comprising:

performing a harvesting operation at the first ice maker;

determining, via the second water lever sensor, that the quantity of water within the water tank is below the maximum water level;

supplying leftover water from the first ice maker to the water tank after performing the harvesting operation and determining that the quantity of water within the water tank is below the maximum water level;

receiving an input request from the second ice maker; and supplying a predetermined amount of water from the water tank to the second ice maker in response to receiving the input request from the second ice maker.

18. The refrigerator appliance of claim 17, further comprising:

a water dispenser provided within a door of the refrigerator appliance, the water dispenser being in fluid communication with the water tank.

19. The refrigerator appliance of claim 17, further comprising:

a main filter positioned at the water inlet within the cabinet to filter incoming water;

a first water supply line fluidly connecting the water inlet with the first ice maker via the main filter; and a second water supply line fluidly connecting the water inlet with the water tank via the main filter, wherein the first water supply line is in fluid parallel with the second water supply line.

20. The refrigerator appliance of claim 17, further comprising:

a secondary filter positioned between the first ice maker and the water tank, wherein the leftover water from the first ice maker is filtered through the second filter before being supplied to the water tank.

* * * * *